United States Patent [19]

Harvey et al.

[11] Patent Number: 4,918,794

[45] Date of Patent: Apr. 24, 1990

[54] PULL FOR SLIDE FASTENER SLIDERS

[75] Inventors: Billy R. Harvey; David W. Rohrer, both of Jackson, Wyo.

[73] Assignee: Life-Link International, Inc., Jackson, Wyo.

[21] Appl. No.: 107,095

[22] Filed: Oct. 13, 1987

[51] Int. Cl.[5] ..... A44B 19/26

[52] U.S. Cl. ..... 24/429; 24/419; 24/411

[58] Field of Search ..... 24/429, 411, 415, 384, 24/387, 389, 30.5 R, 30.5 S, 30.5 P, 482, 17 AP; 294/3.6; 128/165

[56] References Cited

U.S. PATENT DOCUMENTS

| | | | |
|---|---|---|---|
| 1,164,928 | 12/1915 | Corcoran | 24/3 A |
| 1,219,881 | 3/1917 | Sundback | 24/411 |
| 1,243,458 | 10/1917 | Sundback | 24/411 |
| 1,260,434 | 3/1918 | Nordseth | 24/482 |
| 1,302,606 | 5/1919 | Sundback | 24/429 |
| 2,185,853 | 1/1940 | Knoess | 24/429 |
| 2,800,699 | 7/1957 | Armstrong | 24/387 |
| 2,841,851 | 7/1958 | Van Amburg et al. | 24/384 |
| 2,970,729 | 2/1961 | Allen | 24/30.5 P |
| 3,354,520 | 11/1967 | Morgen | 294/3.6 |
| 3,641,634 | 2/1972 | Asai | 24/429 |
| 3,789,842 | 2/1974 | Froimson | 128/165 |
| 3,971,458 | 7/1976 | Koenig | 24/387 |
| 3,997,943 | 12/1976 | Jones et al. | 24/30.5 P |
| 4,048,991 | 9/1977 | Marx | 128/165 |
| 4,150,463 | 4/1979 | Brown | 24/30.5 P |
| 4,216,257 | 8/1980 | Schams et al. | 24/448 |
| 4,631,783 | 12/1986 | Hayashi | 24/30.5 S |

FOREIGN PATENT DOCUMENTS

| | | | |
|---|---|---|---|
| 1030200 | 6/1953 | France | 24/17 AP |
| 7412773 | 4/1975 | Netherlands | 24/429 |
| 2117445 | 10/1983 | United Kingdom | 24/415 |

*Primary Examiner*—Victor N. Sakran

*Attorney, Agent, or Firm*—Andrew D. Maslow

[57] ABSTRACT

An attachment to a zipper pull tab is provided. The attachment is a flexible elongaged member with its length being at least twice its width. The upper portion of the flexible elongated member is provided with an opening through which the lower portion of the elongated member may be inserted.

7 Claims, 1 Drawing Sheet

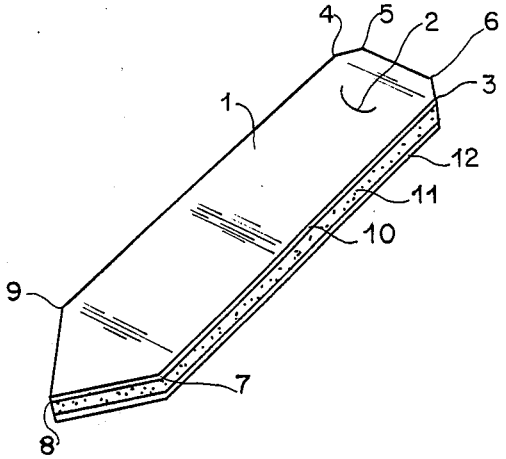
FIG. 1
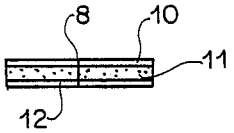
FIG. 2
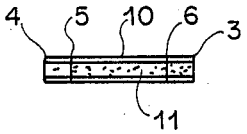
FIG. 3
FIG. 4
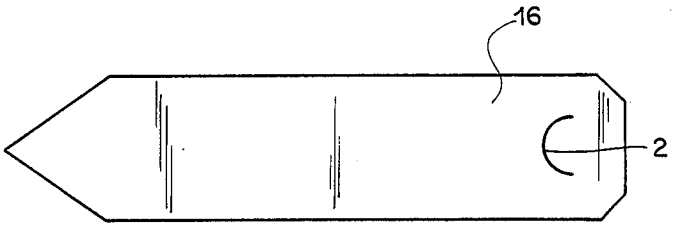
FIG. 5
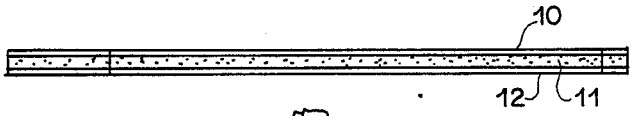
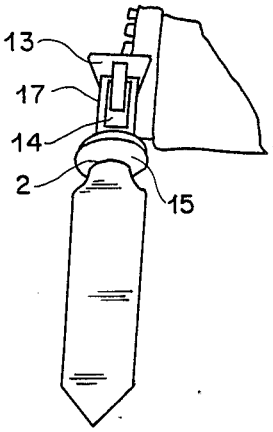
FIG. 6

PULL FOR SLIDE FASTENER SLIDERS

BACKGROUND OF THE INVENTION 1.0 Field of the Invention

The present invention relates to an attachment for the pull tab of a slide fastener ("zipper") slider.

2.0 Prior Art

Many ornamental attachments have been known which are attachable to the slider pull tabs of a zipper to make the later more attractive or easier to operate. For example U.S. Pat. Nos. 1,219,881 and 1,243,458 show a tape or bow attached to the slider of a zipper. U.S. Pat. No. 1,302,606 shows a cord attached to the slider of the zipper.

In U.S. Pat. No. 2,841,851, a pull member is attached to the slider of a zipper.

SUMMARY OF THE INVENTION

The instant invention provides for an improved pull for a zipper slider which is not only flexible but elastic thereby providing a spring action to the slider when a force is applied to the attachment.

In accordance with the invention, a zipper is provided including a slider, a pull tab connected to the slider and a flexible elastic elongated member attached to the pull tab. The flexible elastic elongated member has a length at least twice that of its width. A slot or opening is formed in the upper portion of the member and is of a sufficient size to allow the lower end of the elongated member to be fully inserted through the slot. The elongated member is made of an elastic material upon which there is a fabric backing on at least one side. The flexible material may be an elastomeric foam and the fabric a woven Nylon Tricot. Four corners on the upper portion of the elongated member define a trapezoid and three corners on the lower portion of the elongated member define a triangle.

The elongated member is attached to the pull tab by inserting the lower portion of the elongated member through a slot in the pull tab and pulling the elongated member through said slot in the pull tab without pulling the opening in the upper portion of the elongated member through the slot in the pull tab. The lower portion of the elongated member is now inserted through the opening in the upper portion of the elongated member and pulled tightly. The result is the flexible elongated member is securely attached to the pull tab and takes the shape of a necktie tied in a Windsor knot.

It is an object of the present invention to provide an attachment for the slider of a zipper which can easily be attached thereto.

Another object of the invention is to provide an attachment which, when attached to the pull tab of a zipper assists in the operation of the zipper by a spring type mechanism.

Still another object of the invention is to provide an attachment for a zipper slider which, when fully attached, takes the shape of a necktie in a Windsor knot.

Yet another object of the invention is to provide an ornamental attachment for a slider of a zipper upon which a monogram or similar design can be easily placed.

Another object of the present invention is to provide an ornamental attachment to the slider of a zipper which is reversible and thus gives the user the option of two different colors or designs.

Many other advantages, features and additional objects of the present invention will become manifested to those versed in the art upon making reference to the detailed description and the accompanying drawings in which the preferred structural embodiments incorporating the principles of the present invention are shown by way of illustrative example.

BRIEF DESCRIPTION OF THE DRAWINGS

FIG. 1 is a perspective view of the front of the invention.

FIG. 2 is a bottom view of the invention.

FIG. 3 is a top view of the invention.

FIG. 4 is a back view of the invention.

FIG. 5 is a side view of the invention.

FIG. 6 is a perspective view of the invention installed on a zipper pull tab.

DETAILED DESCRIPTION

As shown in FIG. 1, the invention comprises a short, elastic elongated member measuring preferably 2½ to 3 inches in length. At the lower portion thereof a triangle is formed by points 7, 8 and 9. At the upper portion of the elongated member a trapizoid is formed by points 3, 4, 5 and 6. Also at the upper portion of the elongated member a semi-circular or V-shaped slot 2 is found and is of a sufficient size to allow the lower portion of the elongated member to be passed through the slot.

The elongated member is preferably made from elastomeric foam 11 covered on the front side by a fabric 10, preferably a woven Nylon Tricot. Preferably the back 16 of the elongated member is also a fabric 12 laminated to the elastomeric foam 11.

In FIG. 6, the preferred embodiment of the invention is shown installed on a pull tab 17 of zipper 13. The elongated member has been inserted through slot 14 of pull tab 17 and then inserted through semi-circular slot 2 and pulled tightly in order to form an appearance of a Windsor knot 15. It can be easily seen that the elongated member has been transformed in FIG. 6 into a zipper pull which takes on the appearance of a neck tie.

If desired, one may place a monogram on the front of the elongated member for identification or decorative purposes.

It should be readily apparent that fabric backings 10 and 12 may be of different colors and thereby giving the user the option of two different colors for the zipper pull.

Preferably the length of the elongated member is at least twice that of its width. Slot 2 may be a straight line, semi-circular or V-shaped.

The invention provides, not only a decorative zipper or slide fastener pull, but also, due to its elastic nature, provides a spring action mechanism for assisting in the operation of the slide fastener upon which the elongated member is attached.

Although various modifications might be suggested to those versed in the art, it should be understood that it is intended to embody within the scope of the patented granted hereon, all such embodiments as reasonably and properly come within the scope of this contribution to the art.

The following is claimed as the invention:

1. In a slide fastener comprising a slider and a pull tab connected to said slider having an opening therein, the improvement comprising a flexible elastic pull member attachment attached to said pull tab, said member having a length at least twice that of its width and an upper and lower portion thereof, the upper portion of said member defining a slot of a size sufficient to accept the lower portion of said member, said member comprising an elastomeric foam with a fabric backing on at least one side thereof.

2. An attachment according to claim 1 wherein said fabric is a woven Nylon Tricot material.

3. An attachment according to claim 1 wherein said elongated member is shaped so that a trapezoid is defined by four corners of the upper portion thereof.

4. An attachment according to claim 3 wherein a triangle is defined by three corners of the lower portion of the member.

5. An attachment according to claim 1 wherein said slot in the upper portion of the elongated member is V-shaped.

6. An attachment according to claim 5 wherein a design is placed on the fabric of at least one side of the flexible elastic elongated member.

7. An attachment according to claim 1 wherein said fabric backing is on both sides of the elastomeric foam material.

* * * * *